United States Patent [19]

Smith

[11] Patent Number: 4,566,607

[45] Date of Patent: Jan. 28, 1986

[54] BAG DISPENSER

[76] Inventor: David L. Smith, 101 Sherman St., Albany, N.Y. 12206

[21] Appl. No.: 613,789

[22] Filed: May 24, 1984

[51] Int. Cl.[4] ..... B65D 5/72

[52] U.S. Cl. ..... 221/155; 221/305; 229/17 R; 229/17 B

[58] Field of Search ..... 221/63, 155, 302, 305, 221/309; 229/17 B, 17 R, 20

[56] References Cited

U.S. PATENT DOCUMENTS

| | | | |
|---|---|---|---|
| 1,119,213 | 12/1914 | Abt | 221/305 |
| 1,973,237 | 9/1934 | Vilas | 229/17 B |
| 2,002,485 | 5/1935 | Alfred | 229/17 R |

FOREIGN PATENT DOCUMENTS

| | | | |
|---|---|---|---|
| 240681 | 8/1962 | Australia | 229/17 B |
| 1057262 | 3/1954 | France | 229/17 B |
| 2245202 | 4/1975 | France | 221/63 |

*Primary Examiner*—Charles A. Marmor
*Attorney, Agent, or Firm*—Walter F. Wessendorf, Jr.

[57] ABSTRACT

Disclosed is a bag dispenser for the storing therein and drop-down dispensing therefrom of shopping bags comprising a blank divided by fold line and slit lines defining a front wall, left and right side walls, back wall, back wall seal flap, left and right side bottom flaps, top cover, top cover lock flap, and left and right side top flaps. The blank is folded along its fold lines and is assembled to form a box-like structure. The front wall, correspondingly perforated in configuration, defines an inverted T-shaped panel which is removed via the resulting weakened tear line. Such removed T-shaped panel provides a horizontal slot portion through which the shopping bags may be dispensed one at a time and a centrally located vertical slot portion for determining the number of shopping bags stored in such dispenser.

2 Claims, 15 Drawing Figures

BAG DISPENSER

BACKGROUND OF THE INVENTION

1. Technical Field

This invention relates to a bag dispenser for the storing therein and the drop-down dispensing therefrom of empty paper shopping bags.

2. Background

Consumers all over the country visit their favorite supermarkets to do their grocery shopping at the very least once a month, if not twice a month or even once a week.

No matter how often one frequents the store to buy something there is always the problem of what to do with the empty paper shopping bags.

Most shoppers like to save their paper shopping bags for various uses around the home, such as for use as a temporary trash bag, as a sandwich bag, for sending a bowl of food to a relative, as a storage bag for small items, or even to put other bags therein for storage.

Again, the problem is what to do with the paper shopping bags that are saved and are waiting to be used. Some of the most common places where shopping bags can be found in the home are:

a. In a cabinet drawer;
b. Behind a kitchen appliance or cabinet;
c. Under a counter;
d. In another shopping bag; or
e. Piled in a convenient corner.

Whenever the paper shopping bags are kept, they are usually still untidy, can be an eye-sore in the home, are not easily accessible, can take up valuable space, and can become a fire hazard if stored improperly.

The answer is to get a bag dispenser to neatly store the three main types of bags that are saved, to wit: shopping bags, 25 lb. bags and 12 lb. bags.

The problem in the art to which this invention apertains is the need for a bag dispenser to store therein empty paper shopping bags and to dispense them therefrom one at a time.

SUMMARY OF THE INVENTION

In accordance with the invention, there is provided a bag dispenser made of corrugated cardboard or other suitable material. The bag dispenser is formed from a blank divided by fold lines and slit lines to form it into a box-like bag dispenser having a front wall with a view, finger and bag opening, right and left side walls, a back wall, a top cover and a bottom seal flap. The bag dispenser of this invention has the following structural features and functional attributes and advantages, to wit:

1. It is easy to fold and form into the bag dispenser;
2. There are only two surfaces to be sealed once the bag dispenser is formed, i.e., the right side wall and the bottom seal flap;
3. The top cover has a lock flap for fastening;
4. After the perforated, inverted T-shaped panel is removed from the front wall for view and bag opening, the right and left side bottom flaps remain functional;
5. The vertical slot portion of the T-shaped panel removed from the front wall provides an excellent view of the folded shopping bags stored in the dispenser;
6. The corresponding cut-out portions of the right and left side bottom flaps and the bottom seal flap provide a finger opening that makes grabbing and removing a stored paper bag easier from the horizontal slot portion of the removed T-shaped panel, and therefor any jam ups can be easily corrected.

BRIEF DESCRIPTION OF THE DRAWINGS

This object and other objects of the invention should be discerned and appreciated from the detailed description in conjunction with the drawings, wherein like reference numerals refer to similar parts throughout the several views, in which.

DESCRIPTION OF THE PREFERRED EMBODIMENT

Figure 1:
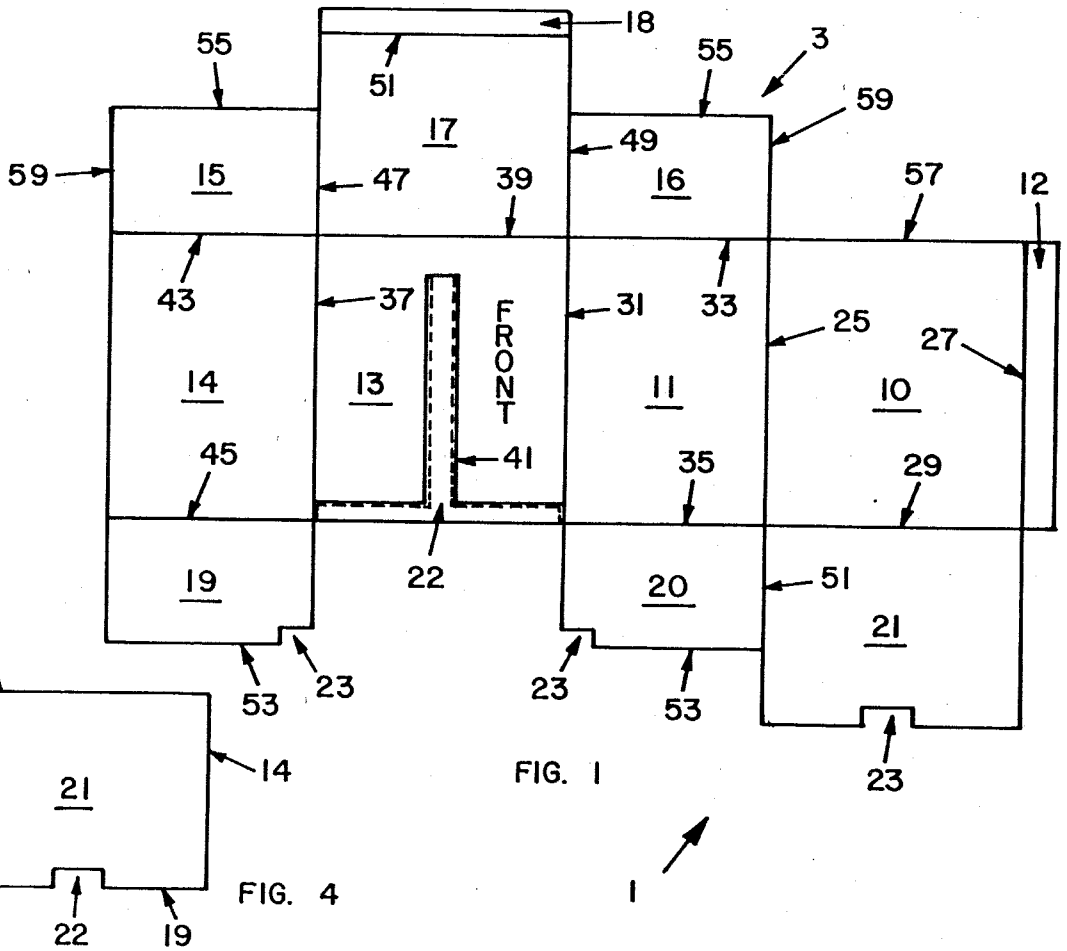
FIG. 1 is a plan view of the blank from which the bag dispenser is formed.

In FIG. 1 of the drawings, reference numeral 1 generally refers to the invention of the bag dispenser comprising a blank 3 of corrugated cardboard or other suitable material divided by its fold lines and slit lines to form it into such bag dispenser.

The back wall 10 has a fold line 25 dividing it from left side wall 11; a fold line 27 dividing it from back wall seal flap 12; and a fold line 29 dividing it from bottom flap 21.

Left side wall 11 has a fold line 31 dividing it from front wall 13; a fold line 33 dividing it from left side top flap 16; and a fold line 35 dividing it from left side bottom flap 20.

Front wall 13 has a fold line 37 dividing it from right side wall 14; and a fold line 39 dividing it from top cover 17. As is indicated by reference numeral 41, front wall 13 is perforated, as shown, to define a weakened tear-line and, as such, to constitute a correspondingly inverted T-shaped panel 22 removable from front wall 13 to provide a horizontal slot portion from which a paper shopping bag can be dispensed one at a time and to provide a centrally disposed viewing slot portion for determining the number of stored shopping bags remaining in such dispenser.

Right side wall 14 has fold line 43 dividing it from right side top flap 15; and a fold line 45 dividing it from right side bottom flap 19.

Right side top flap 15 and top cover 17 are slit along line 47 to separate each from the other; left side top flap 16 and top cover 17 are slit along line 49 to separate each from the other; and top cover 17 has a fold line 51 dividing it from top cover lock flap 18.

Left side bottom flap 20 and bottom seal flap 21 are slit along line 51 to separate each from the other.

FIG. 1 depicts the exterior of the blank 3. The flat interior portions of the back wall seal flap 12 and bottom seal flap 21 have self-adhesive.

Figure 2:
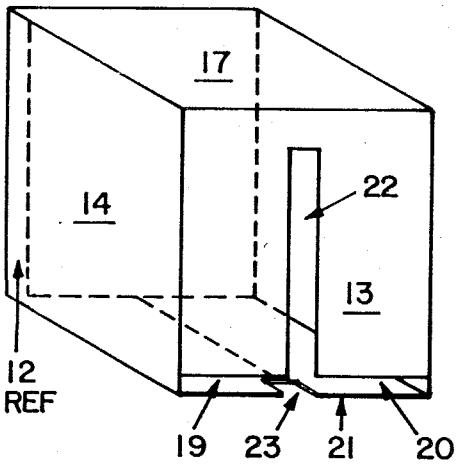
FIG. 2 is a perspective view of the assembled bag dispenser.
Figure 3:
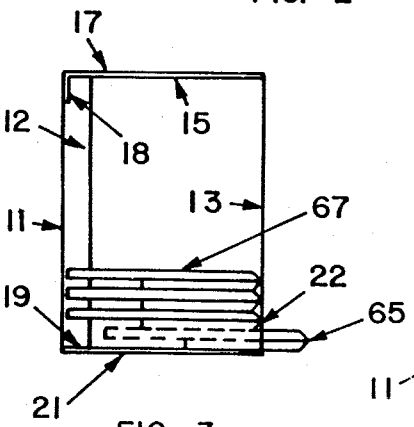
FIG. 3 is a side view.
Figure 4:
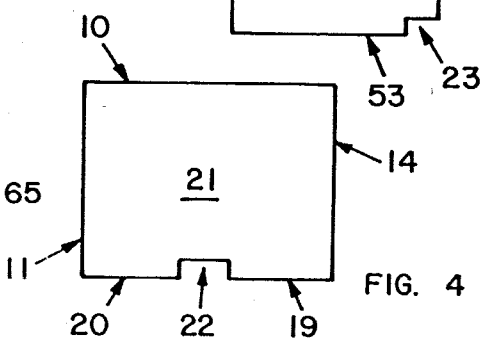
FIG. 4 is a bottom view.
Figure 5:
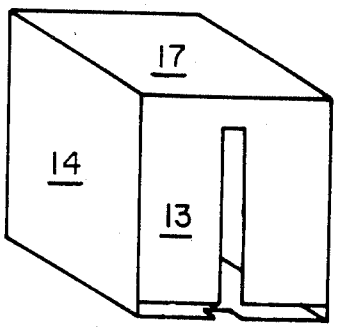
FIG. 5 is a perspective view of the bag dispenser.
Figure 6:
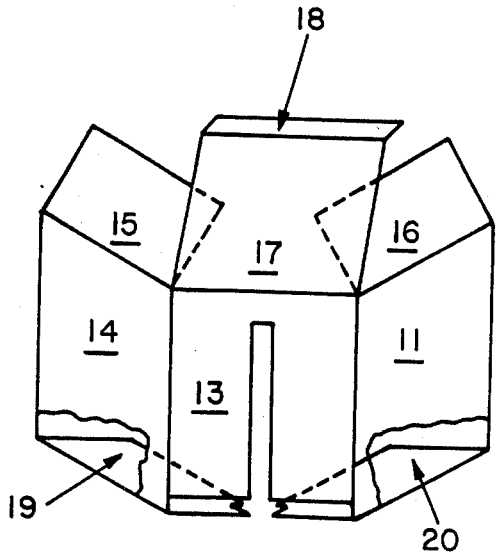
FIG. 6 is a front view showing partial assembly.
Figure 7:
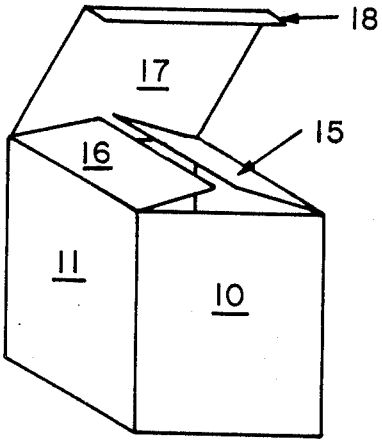
FIG. 7 is a perspective view showing the top cover and right and left side top flaps preparatory to assembly.
Figure 8:
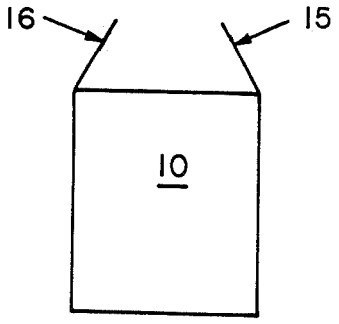
FIG. 8 is a back view.
Figure 9:
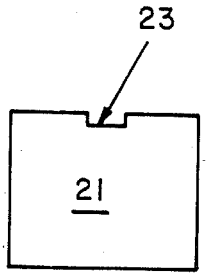
FIG. 9 is a bottom view.
Figure 10:
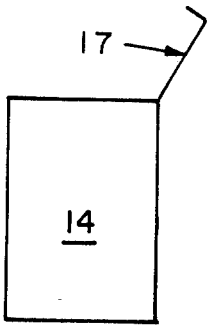
FIG. 10 is a side view showing the top cover preparatory to assembly.

In the assembly of the bag dispenser 1, the T-shaped pannel 22 is first removed. Then the back wall 10, left side wall 11, front wall 13 and right side wall 14 are appropriately folded to form the box-like structure as shown in FIG. 2 with the adhesive portion of back wall seal flap 12 retentively engaged with right side wall 14. The right and left side bottom flaps 19 and 20 are folded up sufficiently to dispose their common edges 53 in abutting relationship and the adhesive portion of bottom seal flap 21 is appropriately disposed in retentive engagement with right and left side bottom flaps 19 and 20. Upon assembly of the bottom flaps 19 and 20, and bottom seal flap 21, the corresponding cut-out portions 23 define a finger opening which together with the vertical viewing slot portion of the removed T-shaped panel 22 facilitate manipulative insertion of the human operator's thumb and index finger therethrough to grasp the lowermost stacked shopping bag for its removal from the dispenser 1 through the horizontal slot portion of such removed T-shaped panel 22. The top flaps 15 and 16 are folded down sufficiently to dispose their common edges 55 in abutting relationship, and the top cover 17 is correspondingly folded down upon top flaps 15 and 16, and with the top cover lock flap 18 removably inserted in retentive wedging relationship between the edge 57 of back wall 10 and the common edges 59 of top flaps 15 and 16, as shown in FIG. 3.

Figure 14:
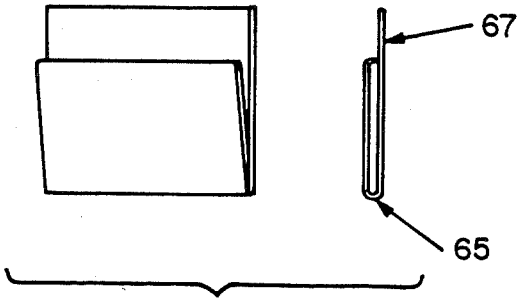
FIG. 14 shows such paper shopping bag with a new crease as folded preparatory to its storage in the bag dispenser.
Figure 15:
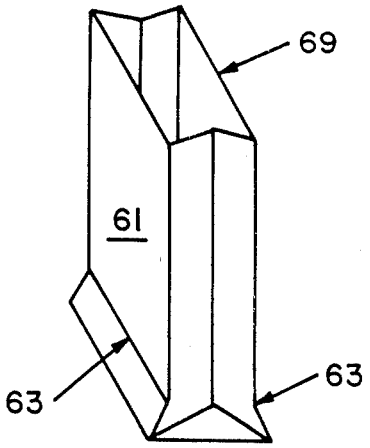
FIG. 15 shows an empty paper shopping bag.
Figure 13:
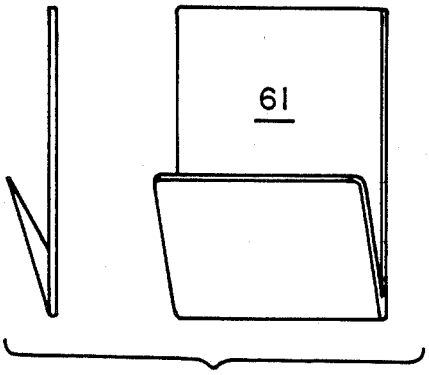
FIG. 13 shows a paper shopping bag folded along its original creases.
Figure 11:
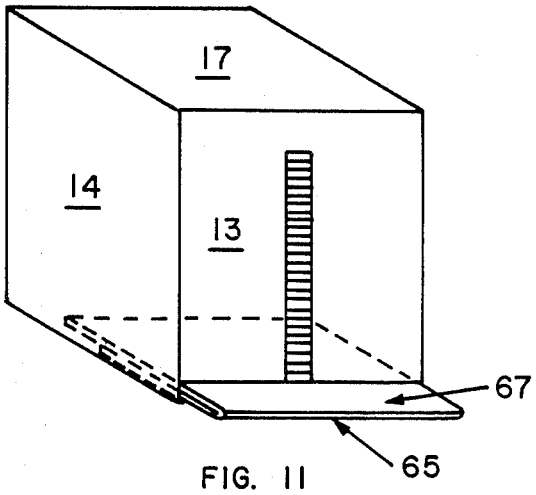
FIG. 11 is a perspective view showing the bag dispenser filled with paper shopping bags.
Figure 12:
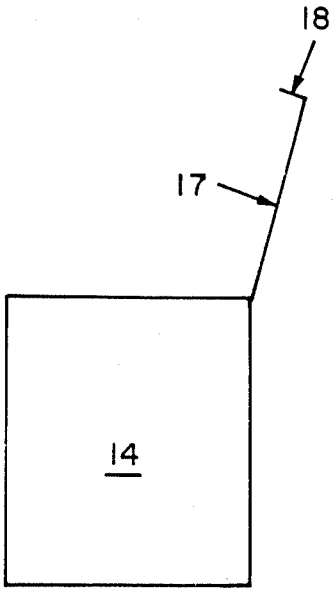
FIG. 12 is a side view showing the top cover open to fill the dispenser with paper shopping bags.

Preparatory to storing shopping bags 61 in the dispenser 1, each shopping bag 61 is folded along its original creases 63, as shown in FIG. 13, and is then folded again making a new crease 65, as shown in FIG. 14. Then the folded shopping bag 61 is placed in the bag dispenser 1 with the flat side 67 facing up and with the bag opening 69 facing toward the back of the dispenser 1. A sufficient quantity of shopping bags 61 is similarly folded and stacked in the bag dispenser 1 until same is filled or until the quantity available is folded and stacked. Then the top flaps 15 and 16 are folded down, the top cover 17 is folded down thereupon and the top cover lock flap 18 is retentively inserted in such wedging relationship as previously described.

As the lowermost shopping bag 61 is removed from the dispenser 1 through the horizontal slot portion, the remaining shopping bags 61, stacked in dispenser 1, drop down.

Having thusly described my invention, I claim:

1. A bag dispenser for the storing therein and drop-down dispensing therefrom of shopping bags, said bag dispenser being reopenable and reclosable for refill storage of shopping bags therein; said bag dispenser comprising a blank divided by fold lines and slit lines to form it into said bag dispenser, said blank defining a front wall, left and right side walls, a back wall, a back wall seal flap, left and right side bottom flaps, a bottom seal flap, a top cover, a top cover lock flap, and left and right side top flaps, said front wall having a fold line dividing it from said left side wall, said front wall having a fold line dividing it from said right side wall, said front wall having a fold line dividing it from said top cover, said left side wall having a fold line dividing it from said back wall, said left side wall having a fold line dividing it from said left side top flap, said left side wall having a fold line dividing it from said left side bottom flap, said back wall having a fold line dividing it from said bottom seal flap, said back wall having a fold line dividing it from said back wall seal flap, said right wall having a fold line dividing it from said right side top flap, said right side wall having a fold line dividing it from said right side bottom flap, said top cover having a fold line dividing it from said top cover lock flap, said top cover having a fold line dividing it from said left side top flap, said top cover having a fold line dividing it from said right side top flap, said right side top flap and top cover being slit along a common line and separating each from the other, said left side top flap and top cover being slit along a common line separating each from the other, said left side bottom flap and bottom seal flap being slit along a common line separating each from the other, said back wall seal flap and bottom seal flap having self-adhesive portions; in the assembly of said bag dispenser: said back wall, left side wall, front wall and right side wall being appropriately folded to form a box-like structure with said adhesive portion of said back wall seal flap retentively engaged with said right side wall; said right and left side bottom flaps having common edges, said right and left side bottom flaps being folded up with their said common edges disposed in abutting relationship with said adhesive portion of said bottom seal flap disposed in retentive engagement with said right and left side bottom flaps; said right and left side top flaps having first common edges and second common edges, said back wall having a edge, said right and left side top flaps being folded down with their said first common edges disposed in abutting relationship and with their said second common edges being aligned and with said top cover folded down upon said right and left side top flaps and with said top cover lock flap removably inserted in retentive wedging relationship between said edge of said back wall and said aligned second common edges of said right and left side top flaps; said front wall having an inverted T-shaped panel formed by the removal of a weakened tear-line corresponding in configuration thereto providing upon its removal a horizontal slot portion from which said shopping bags stored in said bag dispenser can be dispensed one at a time and providing a vertical slot for visual indication of the number of stored shopping bags; and said bag dispenser being reopenable for refill storage of shopping bags therein by appropriate disengagement of said top cover lock flap from its retentive wedging relationship between said edge of said back wall and said aligned second common edges of said right and left side top flaps and appropriate raising up of said top cover and right and left side top flaps to provide access to said bag dispenser.

2. A bag dispenser in accordance with claim 1, wherein said right and left side bottom flaps and said bottom seal flap have corresponding cut-out portions defining a finger opening which together with said vertical slot portion facilitate manipulative insertion therethrough of a human operator's thumb and index finger to grasp the lowermost stacked shopping bag for its removal through said horizontal slot portion.

* * * * *